US005118100A

United States Patent [19]

Sungaila

[11] Patent Number: 5,118,100

[45] Date of Patent: Jun. 2, 1992

[54] WEIGHT SUPPORTING FRAME FOR WEIGHTLIFTERS

[76] Inventor: Alexander F. Sungaila, P.O. Box 601551, Sacramento, Calif. 95860-1551

[21] Appl. No.: 599,139

[22] Filed: Oct. 17, 1990

[51] Int. Cl.[5] ..... A63B 21/065

[52] U.S. Cl. ..... 482/105; 482/106

[58] Field of Search ..... 272/119, 123, 122, 143, 272/120; 224/270, 197, 185, 273, 44.5, 263, 910

[56] References Cited

U.S. PATENT DOCUMENTS

| | | | |
|---|---|---|---|
| 332,123 | 12/1885 | Walton . | |
| 744,477 | 11/1903 | Bush . | |
| 796,589 | 8/1905 | Maloney . | |
| 3,649,921 | 3/1972 | Thomas . | |
| 3,679,107 | 7/1972 | Perrine . | |
| 4,018,442 | 4/1977 | Galler . | |
| 4,188,965 | 2/1980 | Merman . | |
| 4,213,605 | 7/1980 | McPeak | 272/119 |
| 4,438,763 | 3/1984 | Zablen . | |
| 4,674,160 | 6/1987 | Gibson . | |
| 4,714,247 | 12/1987 | Gerstung . | |
| 4,722,523 | 2/1988 | Yang . | |
| 4,765,612 | 8/1988 | Henry . | |
| 4,944,509 | 7/1990 | Snider | 272/123 |

*Primary Examiner*—Richard J. Apley
*Assistant Examiner*—Jerome Donnolly
*Attorney, Agent, or Firm*—Kenton L. Freudenberg; Maxwell C. Freudenberg

[57] ABSTRACT

A device for use by weightlifters for supporting a substantial weight, specifically a barbell, across the shoulders of an individual wherein the majority of the weight is transferred to the individual's hips and legs to avoid any strain on the back. The supporting device comprises a waist or hip belt, tubular support members extending generally vertically from pivotable mounting points at either side of the belt and shaped to curve around the user's back, a transverse channel cradle member with upwardly open U-shaped cross section extending between the upper ends of the support members to form an adjustably shaped frame. The tubular members are adjustable to vary their length and the distance between their lower ends to fit the user.

23 Claims, 4 Drawing Sheets

WEIGHT SUPPORTING FRAME FOR WEIGHTLIFTERS

BACKGROUND OF THE INVENTION

"Squats" are an exercise commonly performed by weightlifters to develop leg strength. A squat is performed to exert the leg muscles by using normal barbells carried across the shoulders and by squatting down and then standing up against the resistance caused by the weight of the barbells. Because of the relatively great strength of an individual's legs, the quantity of weight used to perform this exercise is typically quite high. Since the weight is carried upon the shoulders, the weight lifter's back must also bear the stress of the weight. This opens the possibility of injury or strain to the back even when the weight being used is readily manageable by leg strength alone. The present invention is intended to allow a barbell to be carried in an ordinary position across the shoulders, but with its weight transferred to the waist or hips of the user to be borne primarily by the legs.

SUMMARY OF THE INVENTION

Weightlifters commonly use a wide stiff belt worn tightly around the waist to provide additional support to the back when lifting heavy weight. The present invention provides a device which incorporates or is attached to such a belt and which has tubular supporting members extending generally vertically from each side of the belt, with sufficient bend or curvature to pass behind and around the user's back and up to the level of the user's shoulders where an open channel or cradle capable of supporting the bar of a barbell extends horizontally and transversely across the ends of the two tubular supports.

Because of the varying anatomical shape and size of individuals, the device of the present invention is provided with means for adjusting (1) the length of the tubular supporting members to accommodate users of varying heights, (2) the fore to aft position of the supporting channel on the user's shoulder's, and (3) the width between the lower ends of the tubular supporting members to accommodate users with varying transverse waist or hip sizes.

Because of the danger involved in lifting heavy weights, it is desirable that any weight being used be safely releasable by the user if, for example, the weight cannot successfully be lifted. By providing horizontal pivot points for the support frame of the present invention which are located approximately at the user's waist, the user can readily and safely drop the weight by merely pushing it backward from his shoulders and allowing the entire frame to pivot backward and downward. The force required to begin such pivoting movement need only be applied horizontally and is, therefore, relatively small in relation to the actual quantity of the weight being lifted. The arced path followed by the weight as the frame pivots has the effect of directing the weight and the user's body apart until the open channel has pivoted to the point where it opens generally downward and the weight is able to drop freely to the ground. This is in substantial contrast to the result of dropping a weight when no such supporting frame is being used where the weight tends to drop nearly vertically since the user cannot readily apply any significant rearward force to the weight.

When a barbell is being supported on the user's shoulders, the channel which supports the barbell is oriented so that when the bar is in place on the weightlifter's shoulders, the open side of the channel faces generally up and forward so that the user may, alternatively, by extending his arms and ducking his head, push the weight freely in that direction and over his head to release it to the front in the same manner as if no supporting frame were being used.

In order to provide more stability and security of the frame, particularly when heavy weights are being used, the frame can also be provided with shoulder straps to prevent undesirable rearward movement of the frame and supported weight. This, of course, limits the ease with which the weight may be safely dropped to the rear.

It is an object of the present to provide a support means for a barbell which allows allow a barbell to be carried in an ordinary position across the shoulders, but with its weight borne primarily by the user's lower body.

It is another object of the invention to provide a body borne support for a set of barbells which provides a means for safely releasing the weight.

It is a further object of the invention to provide a body borne support for a set of barbells which provides a means for safely releasing the weight and which prevents the weightlifter from being caught under a weight which has been released.

DESCRIPTION OF THE PREFERRED EMBODIMENT

Figure 1:
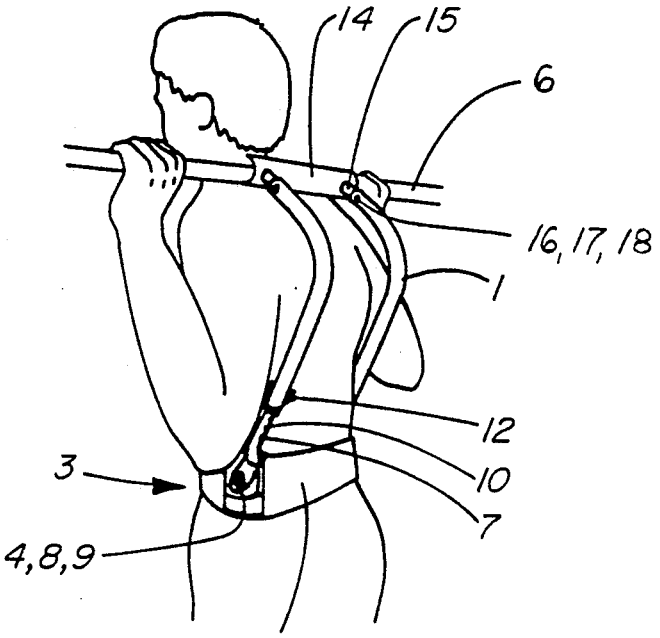
FIG. 1 is a perspective view from the rear of the device of the preferred embodiment as it would be used.

Weightlifters commonly use a wide stiff belt worn tightly around the waist to provide additional support the back when lifting heavy weight. Two embodiments of the present invention provide for (1) a device to be used in conjunction with an existing weightlifters belt or (2) a full device incorporating a belt similar to a weightlifters belt.

The present invention provides a steel frame which extends from pivotable anchor points 4 with generally horizontal axes at either side of a belt. The frame consists of two generally parallel rigid tubular support members 1, each being generally curved through an arc of approximately 65 degrees providing a forwardly concave shape to follow the contour of a human back from a point located at a respective side of the waist, backward and upward around the shoulder blades then forward and upward toward the user's shoulders. At the shoulders a barbell bar 6 is supported by means of a single cradle or channel member 14 of generally U-shaped or semicircular cross section carried generally horizontally and extending between and connecting the ends of the tubular members 1. The length of the channel shaped bar-retaining member 14 is such that the ends thereof which engage and support the barbell bar 6 are at locations sufficiently spaced along a horizontal line extending across the weightlifter's shoulders directly behind the weightlifter's neck to facilitate keeping the center of gravity of the barbell laterally between the ends of the channel member to keep the barbell evenly balanced over the shoulders. In position as used, the channel member 14 is open forward and slightly upward. The inner diameter of the channel member is just slightly larger than that of the outer diameter of the crossbar 6 of a normal barbell. The channel member 14 is provided with perpendicular rigid cylindrical extensions 15 near its ends which are received into the hollow upper ends of the main supporting tubular members 1 and are concentrically secured therein, each forming a pivot for the respective main supporting tube.

Each tubular member 1 is pivotable about its own axis and the axis of the respective channel extension 15. Because of the respective ends are not collinear, the pivoting action allows the lower ends of the tubes freedom to move closer together or farther apart as the belt is adjusted to differing waist sizes. The male portion 15 is provided with a plurality of slots 16 which are elongated circumferentially of the male portion. The tubular end of the main supporting member 1 is provided with diametrically opposed holes 17 to form a diametric opening through the tube. A cylindrical pin or bolt 18 passes through both a selected slot 16 and the holes 17 to secure the respective pieces together at a selectable length. While the width of each of the slots 16 corresponds closely to the diameter of the holes 17 and the pin 18, the elongated length of the slots 16 allows some free play of pin 18 within slot 16. This free play allows the pivoting action of the tubular support member around the axis common to the male member 15 and the upper end of the support member 1 as previously described.

Figure 7:
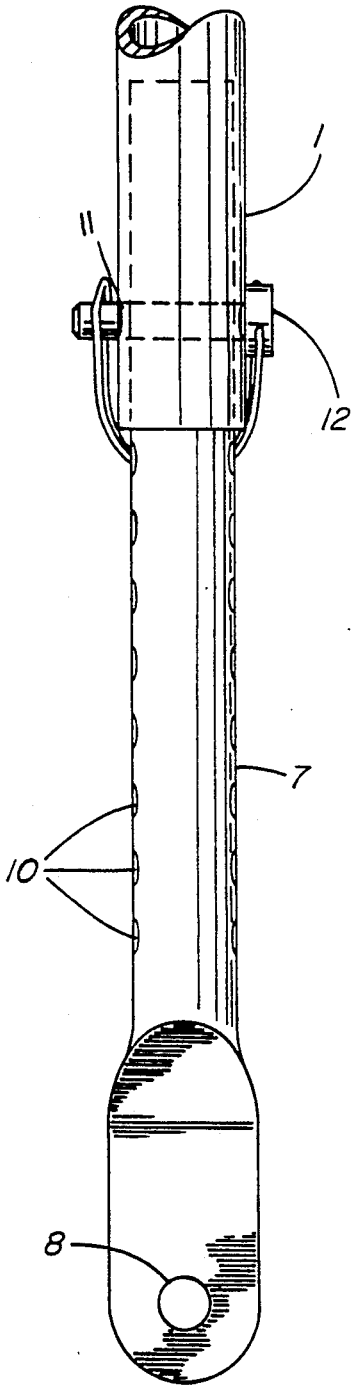
FIG. 7 is a side view showing detail of the telescoping length adjustment of the lower end of a tubular supporting member.
Figure 8:
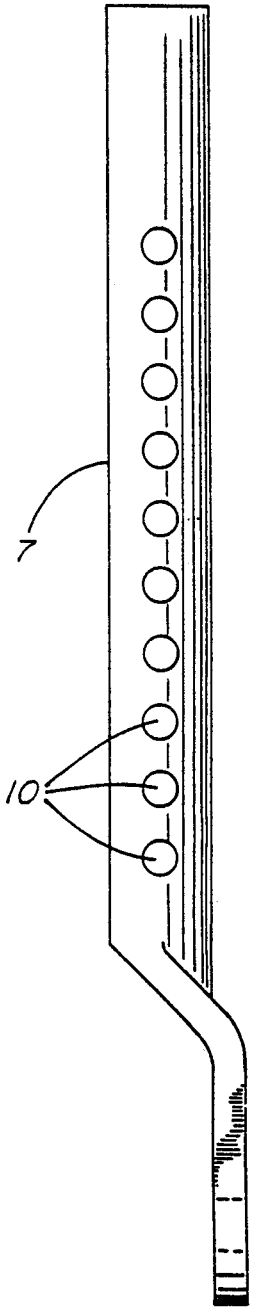
FIG. 8 is a front view of the lower end of a tubular supporting member.

The device is affixed to a belt by means of two steel belt clips 3 each having a narrow downwardly opening channel 5 which slips vertically over the belt 2 and is supported thereby. Each clip 3 may additionally be riveted or otherwise permanently secured to the belt. The belt clips 3 are generally diametrically disposed about the belt and are at either side of the user. Extending horizontally from each belt clip is a cylindrical pivot pin 4 which passes through a hole 8 in the lower male portion 7 of the supporting member to provide a horizontal pivot axis for the respective supporting member. A removable pin 9 passing through one of the holes 13 holds the male portion in place. As shown in FIG. 7, the upper end of each male supporting member 7 is telescopically received within the hollow lower end of the respective main tubular supporting member 1. The male portion 7 is provided with a plurality of holes 10, one of which is selected to align with hole 11 in the supporting tube 1. A removable cylindrical pin 12 to passes through both the selected hole 10 and the hole 11 to secure the respective pieces together at a selectable length.

Figure 9:
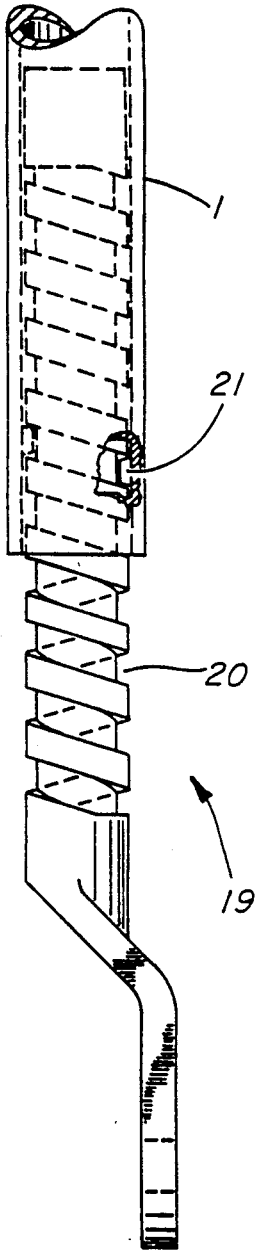
FIG. 9 is a side view showing detail of an alternative embodiment of the lower end of a tubular supporting member which uses a mating threaded channel and pin to provide length adjustment of the supporting member.

Alternatively, the lengthwise adjustment of the lower end of the supporting member may be accomplished by using a simple threaded engagement of the respective telescoping members. As shown in FIG. 9, the male portion 19 may be provided with a spiralled circumferential channel 20 which is engaged by a pin portion 21 on the inner wall of the support member 1. Using this embodiment, the height of the supporting frame is adjusted and fixed by releasing the male member 19 from the pivot 4, rotating it within the supporting tube and then resecuring it to the pivot.

Figure 2:
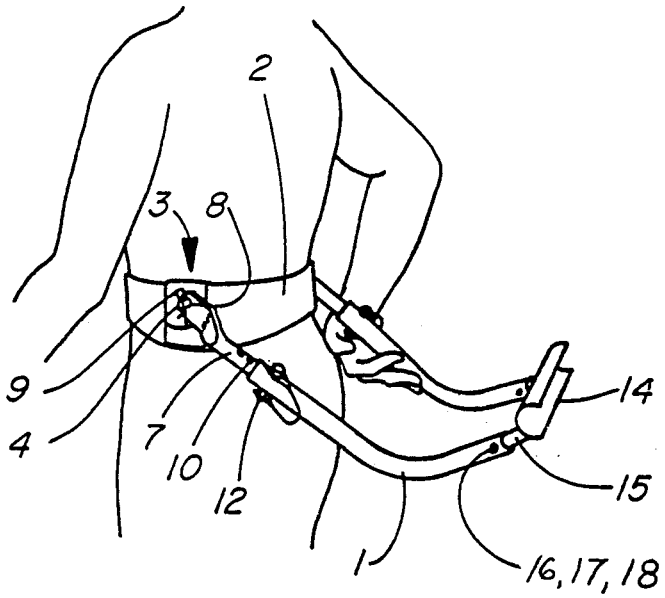
FIG. 2 is a perspective view from the rear of the device of the preferred embodiment showing the device as it would be pivoted to safely release weight rearwardly.
Figure 3:
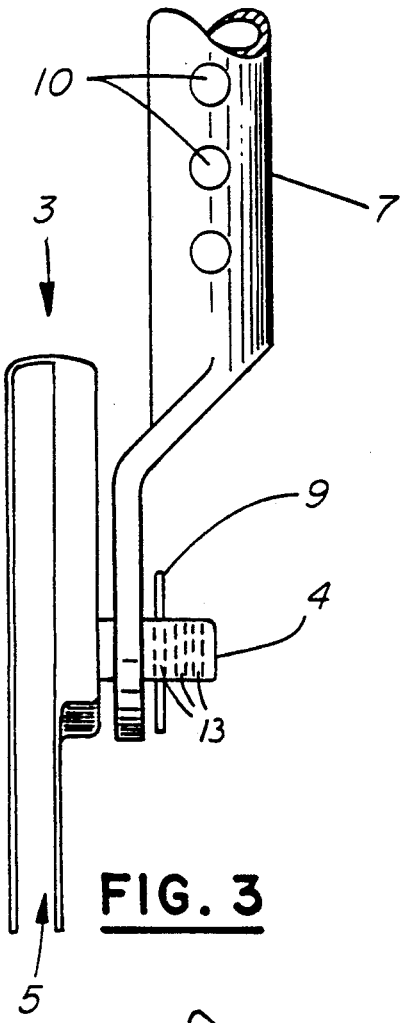
FIG. 3 is a front view showing detail of the belt clip of the preferred embodiment and the pivotable mounting of one of the tubular supporting members.
Figure 4:
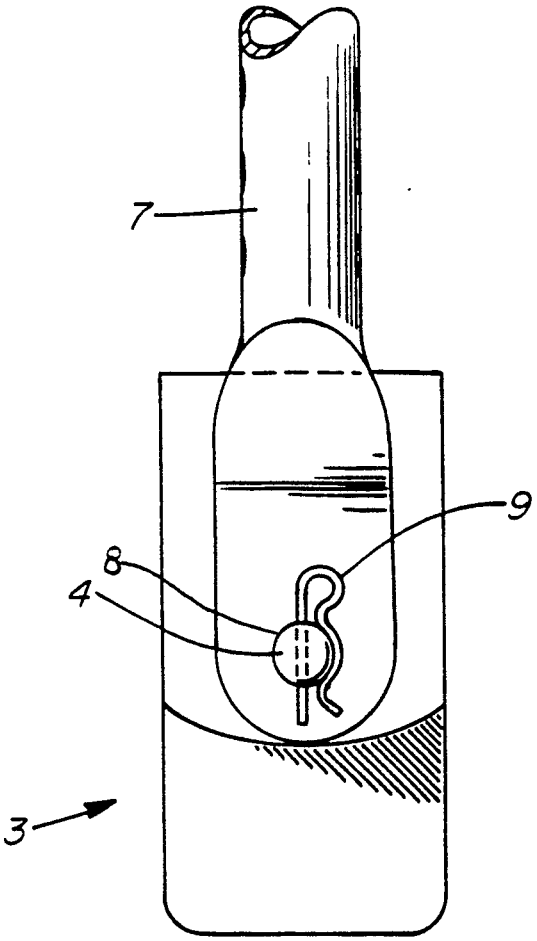
FIG. 4 is a side view showing detail of the belt clip of the preferred embodiment and the pivotable mounting of one of the tubular supporting members.
Figure 6:
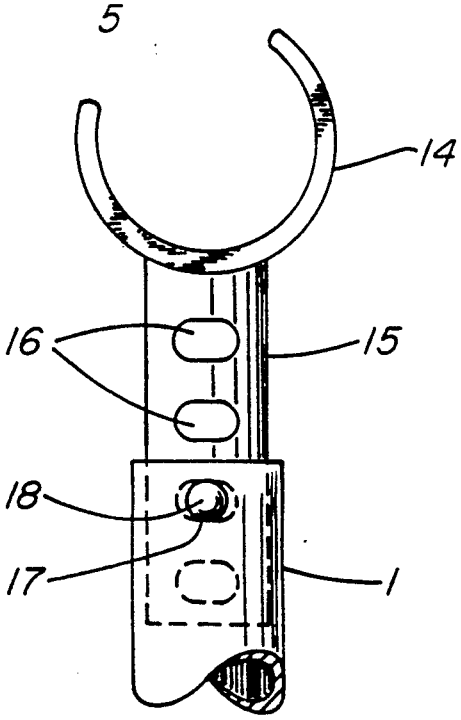
FIG. 6 is a side view showing detail of the pivotable attachment of the upper end of a support member to the bar carrying cradle.
Figure 5:
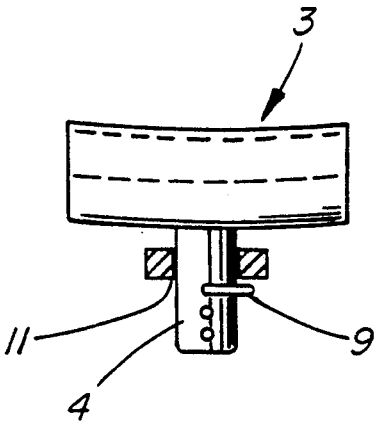
FIG. 5 is an overhead view of the detail shown in FIGS. 3 and 4 showing the tubular supporting members in cross-section.

Normally the barbell is held above the shoulders in the position shown in FIG. 1. As seen in FIG. 1, while performing squat exercises the vertically extending support structure comprising the two elongated tubular support members 1 supports the bar-retaining cradle member 14 in a horizontal position behind the weightlifter's neck across and above the shoulders and is held against an upper portion of the weightlifter's body by grasping the horizontally oriented barbell bar which rests in the cradle at points laterally outwardly beyond the shoulders. In this position essentially all of the barbell weight is transferred by the frame structure to the hips at the two diametrically opposite points at the sides of the user's waist where the support frame is pivotably connected to the belt. The pivotable connection enables the user to move the cradle at the upper end of the support frame generally horizontally toward or away from the shoulders to adjust the cradle position or to enable the support members to perform a swinging movement from a first position as in FIG. 1 to a second position as in FIG. 2 to drop the barbell downwardly away from the body to the rear. To safely drop the weight rearwardly the cradle 14 may be pushed rearward to pivot to or past the position shown in FIG. 2 forcing a horizontal separation between the barbell and the user.

Figure 10:
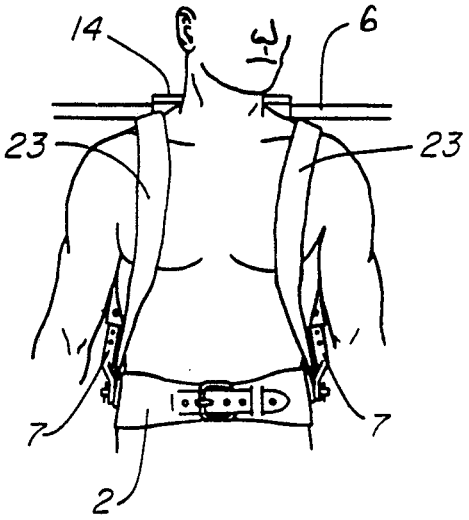
FIG. 10 is a front view of the device of an alternative embodiment in use where shoulder straps are provided for additional stability in supporting the weight.
Figure 11:
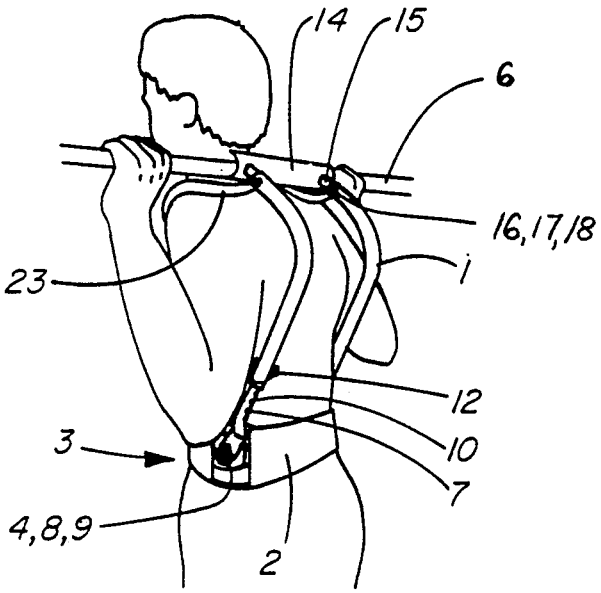
FIG. 11 is a perspective view from the rear of the embodiment shown in FIG. 10.

Alternatively, as shown in FIGS. 10 and 11, the supporting frame can be provided with straps 23 passing in front of the shoulders to provide additional stability for the weight being borne by the frame. Each strap 23 is suitably affixed at its upper end to the upper end of the respective main support tube. The lower end of each strap may be provided with a ring which is readily affixed to pivot 4 and held in place in conjunction with and in the same manner as the lower end of the male portion of the supporting member by the pin 9 passing through one of the holes 13.

Other variations within the scope of this invention will be apparent from the described embodiment and it is intended that the present descriptions be illustrative of the inventive features encompassed by the appended claims.

What is claimed is:

1. Squat exercising weightlifting apparatus for supporting the weight of a barbell from its bar held in a position directly behind a weightlifter's neck and across and above the weightlifter's shoulders and evenly balanced thereover, and transferring said weight to the weightlifter's hips while performing squats, said apparatus consisting essentially of:

support means for resting on the weightlifter's hips and having portions at least partially embracing the weightlifter's body to hold the support means on the weightlifter's hips, a vertically extending rigid support structure connected to said support means and extending upwardly therefrom solely behind the weightlifter's shoulders, said support structure including upwardly opening bar-retaining cradle means having bar-engaging support portions near each shoulder of the weightlifter and at spaced locations along a line directly behind the weightlifter's neck for engaging and supporting the bar in said position with essentially all of the weight of the barbell being transferred by the support structure to the weightlifter's hips when the bar is in the cradle means while performing squats, said bar-engaging support portions providing a horizontal orientation of the barbell bar behind the neck when the apparatus is in its normal barbell supporting position while doing squats.

2. Apparatus according to claim 1 wherein said support means is a belt.

3. Apparatus according to claim 1 wherein said rigid support structure comprises a frame having a pair of rod structures extending upwardly from the support means to said cradle means and rearwardly of the weightlifter's shoulders.

4. Apparatus according to claim 3 wherein said rigid support structure comprises means interconnecting said rod structures near the shoulders of the weightlifter.

5. Apparatus according to claim 1 wherein said rigid support structure is curved to form a forwardly concave shape passing around and spaced from the weightlifter's shoulder blades.

6. Apparatus according to claim 3 wherein said rod structures are curved to form a forwardly concave shapes passing around and spaced from the weightlifter's shoulder blades.

7. Apparatus according to claim 3 wherein said rod structures are adjustable in length.

8. Apparatus according to claim 3 wherein said rod structures have lower end portions located respectively essentially above the hips.

9. Apparatus according to claim 1 wherein said upwardly opening cradle means loosely retains the bar of the barbell and including means to pivotably connect said rigid support structure to said support means for swingable movement rearwardly and downwardly away from the weightlifter's body to allow the bar to fall freely from the cradle means and facilitate safe dropping of the barbell.

10. Apparatus according to claim 8 including means to pivotably connect the lower end portions of the rod structures to said support means for swingable movement of the rigid support structure rearwardly and downwardly away from the weightlifter's body to facilitate safe dropping of the barbell.

11. Apparatus according to claim 8 including means to adjust the distance between the lower end portions of the rod structures to fit the transverse waist size of the weightlifter.

12. Apparatus according to claim 11 wherein strap means extend from spaced portions of each rod structure forwardly and around the front of the weightlifter's shoulders to retain the cradle means above the shoulders.

13. Apparatus according to claim 1 wherein said cradle means is an elongated channel member extending across the shoulders.

14. Apparatus according to claim 1 wherein said support means includes a conventional weightlifting belt and means for detachably connecting said rigid support structure to said belt.

15. Apparatus according to claim 3 wherein each of said rod structures includes length adjustment means comprising telescoping rod and sleeve portions, said rod and sleeve portions each being provided with at least one set of mating holes with a pin passed therethrough and where at least one of said sleeve and rod portions of each rod structure is provided with a plurality of sets of such holes.

16. Apparatus according to claim 3 wherein each of said rod structures has an arcuate configuration and includes means for adjustably twisting an upper portion of the rod structure whereby lower portions of the rod structures can be adjusted to change the distance therebetween to fit the waist of the weightlifter.

17. Apparatus according to claim 1 wherein said upwardly opening cradle means loosely retains the bar of the barbell and including means to pivotably connect said rigid support structure to said support means for enabling the weightlifter to change the position of the cradle means for swingable movement downwardly and away from the weightlifter's body to allow the bar to fall freely from the cradle means and facilitate safe dropping of the barbell.

18. A device for use by a weightlifter for performing squat exercises and consisting essentially of:

belt means for attachment to the weightlifter's waist, two generally parallel elongated rigid support members, each said support member having first and second ends, each said first end being pivotably mounted to said belt means whereby the support members are capable of swinging movement at opposite sides of the weightlifter's body between a first position and a second position, a channel shaped member extending between the respective second said ends of said support members, said channel shaped member being capable of supporting the crossbar of a normal barbell, said channel shaped member being positioned against an upper portion of the user's body across the shoulders and being open generally upward to engage and support said crossbar when said support members are in said first position, said channel shaped member being positioned behind and below the user's hips and open generally downward when said support members are in said second position to enable the crossbar to fall freely from said channel shaped member and facilitate dropping the barbell.

19. A device according to claim 18 for use by a weightlifter wherein each said elongated support member is curved to correspond to the shape of the weightlifter's back and includes first adjusting means for adjusting its length, the device including second adjusting means for adjusting the distance between said pivotably mounted first ends of the support members.

20. A device for use by a weightlifter for performing squat exercises and consisting essentially of:

belt means for attachment to the weightlifter's waist, two generally parallel elongated rigid support members, each said support member having first and second ends, each first said end being pivotably mounted to said belt means near a hip of the weightlifter whereby the support members are each capable of swinging movement at a respective opposite side of the weightlifter between a first position and a second position, a channel shaped member extending between the respective second said ends of said support members, said channel shaped member being capable of supporting the crossbar of a normal barbell, said channel shaped member being positioned against an upper portion of the user's body across the shoulders and being open generally upward to engage and support said crossbar when said support members are in said first position, said channel shaped member being positioned behind and below the user's hips and open generally downward when said support members are in said second position to allow the crossbar to fall freely from the channel shaped member and facilitate dropping the barbell, each said support member being curved to correspond to the shape of the weightlifter's back.

21. A device according to claim 20 including means for adjusting the length of said support members and means for adjusting the distance between said first ends to enable adjustment of the belt means to fit the waist of the weightlifter.

22. Squat exercising weightlifting apparatus for supporting the weight of a barbell from its bar held by the weightlifter's hands across and outwardly beyond the weightlifter's shoulders and evenly balanced relative to the body, said apparatus enabling the weightlifter to hold the bar toward an upper portion of the weightlifter's body and transferring said weight to the weightlifter's hips during performance of squat exercises, said apparatus consisting essentially of:

support means for resting on the weightlifter's hips and having portions at least partially embracing the weightlifter's body to hold the support means on the weightlifter's hips, a vertically extending rigid support structure connected to said support means and extending upwardly therefrom to said upper portion of the weightlifter's body near the weightlifter's shoulders, said support structure including at its upper end an upwardly opening bar-retaining cradle means having bar-supporting portions near each shoulder of the weightlifter for supporting the bar, said cradle means being held against said upper portion of the body by the weightlifter with essentially all of the weight of the barbell being transferred by the support structure and said support means to the weightlifter's hips during performance of squat exercises, said support structure being movable relative to said support means by the weightlifter during said exercises to enable its upper end to move toward or away from the shoulders to change the position of said cradle means and the bar supported thereby relative to the weightlifter's shoulders, said bar-supporting portions providing a horizontal orientation of the barbell bar across and outwardly beyond the shoulders when the apparatus is being used for squat exercising.

23. Squat exercising weightlifting apparatus for supporting the weight of a barbell from its bar held by the weightlifter's hands across and outwardly beyond the weightlifter's shoulders and evenly balanced relative to the body, said apparatus enabling the weightlifter to hold the bar toward an upper portion of the weightlifter's body and transferring said weight to the weightlifter's hips during performance of squat exercises, said apparatus consisting essentially of:

support means for resting on the weightlifter's hips at diametrically opposed points on opposite sides of the weightlifter's waist and having portions at least partially embracing the weightlifter's body to hold the support means on the weightlifter's hips, a vertically extending rigid support structure connected to said support means at said points and extending upwardly therefrom to said upper portion of the weightlifter's body near the weightlifter's shoulders, said support structure including upwardly opening bar-retaining cradle means having bar-supporting portions near each shoulder of the weightlifter for supporting the bar and held against said upper portion of the body by the weightlifter with essentially all of the weight of the barbell being transferred by the support structure and the support means at said points to the weightlifter's hips, said bar-supporting portions providing a horizontal orientation of the barbell bar across and outwardly to the sides of the weightlifter beyond the shoulders when the apparatus is being used for squat exercising.

* * * * *